US007909434B2

(12) United States Patent
Giere et al.

(10) Patent No.: US 7,909,434 B2
(45) Date of Patent: Mar. 22, 2011

(54) PRINTHEAD AND METHOD OF PRINTING

(75) Inventors: Matthew David Giere, San Diego, CA (US); Bradley D. Chung, Corvallis, OR (US); Jeremy Harlan Donaldson, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 490 days.

(21) Appl. No.: 11/588,445

(22) Filed: Oct. 27, 2006

(65) Prior Publication Data

US 2008/0100669 A1 May 1, 2008

(51) Int. Cl.
*B41J 2/155* (2006.01)

(52) U.S. Cl. ..... 347/42; 347/5; 347/12

(58) Field of Classification Search ..... 347/65, 347/42, 5, 9, 12, 13, 20; 239/135
See application file for complete search history.

(56) References Cited

U.S. PATENT DOCUMENTS 5,308,442 A 5/1994 Taub
5,734,394 A * 3/1998 Hackleman ..... 347/42
6,033,059 A 3/2000 Wen et al.
6,042,222 A * 3/2000 Moritz et al. ..... 347/65
6,364,467 B1 4/2002 Blair
6,409,318 B1 6/2002 Clark
6,520,617 B2 * 2/2003 Blair ..... 347/20
6,959,979 B2 11/2005 Goin et al.
7,448,707 B2 * 11/2008 Jackson Pulver et al. ..... 347/9
2004/0218007 A1 11/2004 Tomizawa et al.
2004/0227786 A1 11/2004 Muraoka
2005/0184169 A1 * 8/2005 Eguchi et al. ..... 239/135
2005/0285906 A1 12/2005 Lee

FOREIGN PATENT DOCUMENTS

EP 0691204 A 1/1996

* cited by examiner

*Primary Examiner* — Lam S Nguyen

(57) ABSTRACT

A printhead having a plurality of drop generators formed on a substrate. Each drop generator includes a nozzle, and the nozzles are arranged in a dual inline architecture. In one embodiment, a column of nozzles includes a first group of nozzles located at a first axial position relative to a scan axis and a second group of nozzles located at a second axial position relative to the scan axis so that all nozzles in the column are located at either the first axial position or the second axial position. The distance along the scan axis between the first axial position and the second axial position is set to reduce dot placement error.

7 Claims, 3 Drawing Sheets

PRINTHEAD AND METHOD OF PRINTING

BACKGROUND OF THE INVENTION

Inkjet printing technology is used in many commercial products such as computer printers, graphics plotters, copiers, and facsimile machines. One type of inkjet printing, known as "drop on demand," employs one or more inkjet pens that eject drops of ink onto a print medium, such as a sheet of paper, to produce dots on the print medium. Printing fluids other than ink, such as preconditioners and fixers, can also be utilized. The pen or pens are typically mounted to a movable carriage that scans or traverses back-and-forth across the print medium. The print medium is advanced between scans in a direction perpendicular to the scanning direction. As the pens are moved repeatedly across the print medium, they are activated under command of a controller to eject drops of printing fluid at appropriate times. The ejection of the drops is controlled so as to form a desired image on the print medium.

An inkjet pen generally includes at least one fluid ejection device, commonly referred to as a printhead, from which the drops of printing fluid are ejected. One common printhead architecture includes a substrate having at least one fluid feed hole and a plurality of drop generators arranged around the feed hole. Each drop generator includes a firing chamber in fluid communication with the fluid feed hole and a nozzle in fluid communication with the firing chamber. A fluid ejector, such as a resistor or piezoelectric actuator, is disposed in each firing chamber. Activating the fluid ejector causes a drop of printing fluid to be ejected through the corresponding nozzle. Printing fluid is delivered to the firing chamber from the fluid feed hole to refill the chamber after each ejection. Generally, only one subset of drop generators is fired at a time to reduce peak current draw. A subset of nozzles that fires simultaneously is referred to as an "address," and a set of adjacent nozzles containing one instance of each address is called a "primitive."

To provide high image quality, each nozzle of the printhead should be able to accurately and repeatedly deposit the desired amount of printing fluid in the proper pixel location on the print medium. However, printhead aberrations can cause misplaced drops that vary from the desired location on the print medium, resulting in what is known as dot placement error. Such dot placement error can have a component in the direction that the carriage is scanned, which component is known as scan axis directionality ("SAD") error. Dot placement error can also have a component in the direction that the print medium is scanned, which component is known as paper axis directionality ("PAD") error.

Printheads are typically constructed so that the nozzles are arranged in two or more columns, each lying perpendicular to the scan axis. In some designs, the nozzles of each column are located at the same axial location relative to the scan axis (i.e., in a straight line perpendicular to the scan axis). Such a configuration is often referred to as an "inline" architecture. With inline designs, the time that elapses between firing can result in SAD error. Other printhead designs strive to reduce SAD error by employing staggered nozzle columns in which various nozzles in a column are located at slightly different locations relative to the scan axis. A staggered nozzle layout is often, but not always, accomplished by providing the drop generators with different shelf lengths. As used herein, the term "shelf length" refers to the distance, for a given drop generator, from the center of the nozzle to the edge of the fluid feed hole adjacent to that drop generator. Staggered printhead designs reduce SAD error by matching the distances between nozzles to the distances traveled by the carriage in the time between firings.

However, material deformations can occur during the fabrication of printheads with staggered designs that create systematic concentricity variations from nozzle to nozzle. These concentricity variations can cause PAD error, which is generally considered to be more problematic than SAD error because it is difficult to compensate for and leads to banding defects.

DETAILED DESCRIPTION OF THE INVENTION

Figure 1:
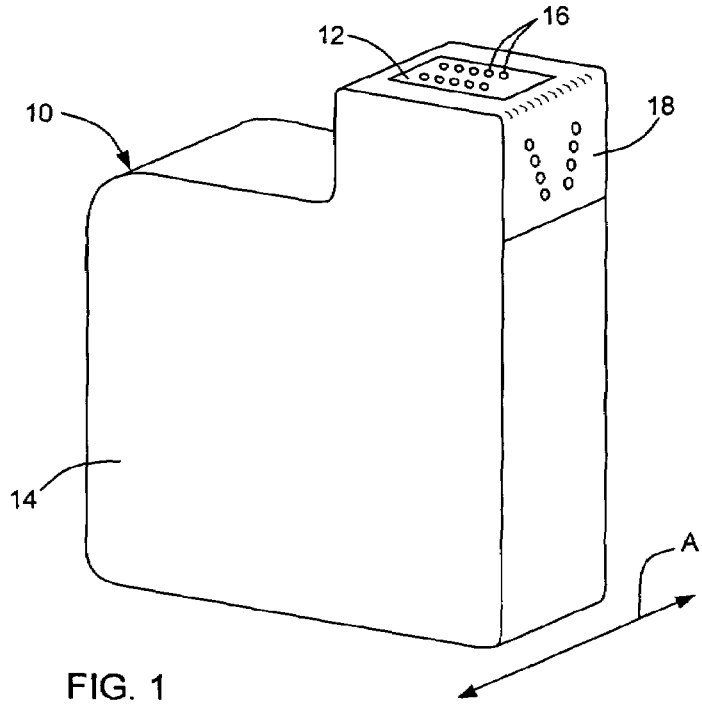
FIG. 1 is a perspective view of one embodiment of an inkjet pen.

Referring to the drawings wherein identical reference numerals denote the same elements throughout the various views, FIG. 1 shows an illustrative inkjet pen 10 having a printhead 12. The pen 10 includes a body 14 that generally contains a printing fluid supply. As used herein, the term "printing fluid" refers to any fluid used in a printing process, including but not limited to inks, preconditioners, fixers, etc. The printing fluid supply can comprise a fluid reservoir wholly contained within the pen body 14 or, alternatively, can comprise a chamber inside the pen body 14 that is fluidly coupled to one or more off-axis fluid reservoirs (not shown). The printhead 12 is mounted on an outer surface of the pen body 14 in fluid communication with the printing fluid supply. The printhead 12 ejects drops of printing fluid through a plurality of nozzles 16 formed therein. Although only a relatively small number of nozzles 16 is shown in FIG. 1, the printhead 12 may have two or more columns with more than one hundred nozzles per column, as is common in the printhead art. The columns are generally perpendicular to the scan axis of the inkjet pen 10. The scan axis, represented by arrow A in FIG. 1, is the axis that the pen 10 is traversed along when in use. Appropriate electrical connectors (such as a "flex circuit") 18 are provided for transmitting signals to and from the printhead 12.

It should be noted that in some applications the inkjet pen has a page wide array in which the printhead is as wide as the print medium and is consequently not scanned across the page. Only the print medium page is advanced relative to the printhead. The present invention is equally applicable to these types of pens and printheads. In this case, the "scan axis" refers to the direction perpendicular to the page axis; i.e., the direction that the page is moved.

Figure 2:
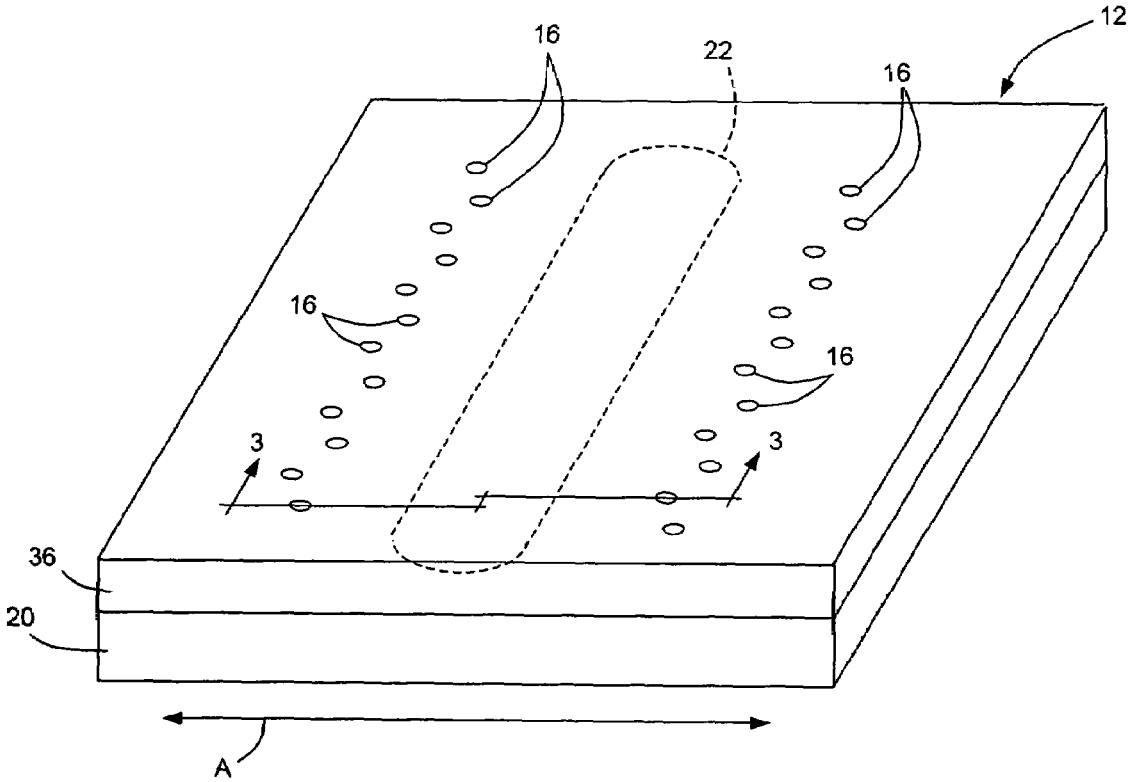
FIG. 2 is a perspective view of one embodiment of a printhead.
Figure 3:
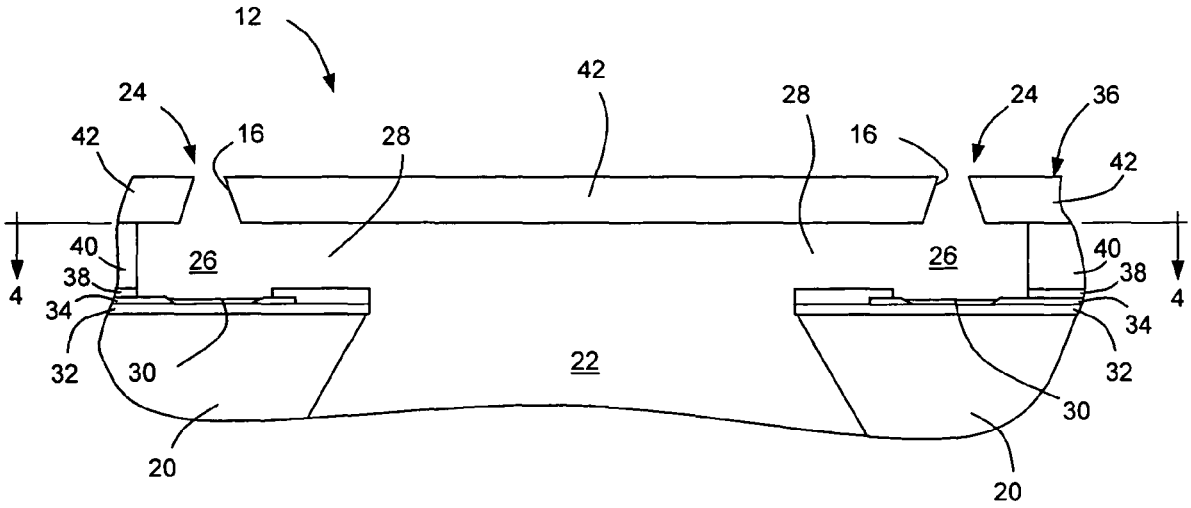
FIG. 3 is a partial cross-sectional view taken along line 3-3 of FIG. 2.

Referring to FIGS. 2 and 3, the printhead 12 includes a substrate 20 having at least one fluid feed hole 22 formed therein with a plurality of drop generators 24 arranged around the fluid feed hole 22. The fluid feed hole 22 is an elongated slot extending generally perpendicular to the scan axis A and in fluid communication with the printing fluid supply. Each drop generator 24 includes one of the nozzles 16, a firing chamber 26, a feed channel 28 establishing fluid communication between the fluid feed hole 22 and the firing chamber 26, and a fluid ejector 30 disposed in the firing chamber 26. The nozzles 16 are thus arranged in two columns, one on each side of the fluid feed hole 22, lying substantially perpendicular to the scan axis A of the inkjet pen 10. The fluid ejectors 30 can be any device, such as a resistor or piezoelectric actuator, capable of being operated to cause drops of fluid to be ejected through the corresponding nozzle 16.

In the illustrated embodiment, an oxide layer 32 is formed on a front surface of the substrate 20, and a thin film stack 34 is applied on top of the oxide layer 32. As is known in the art, the thin film stack 34 generally includes an oxide layer, a metal layer defining the fluid ejectors 30 and conductive traces, and a passivation layer. A fluidic layer assembly 36 comprising a primer layer 38, a chamber layer 40 and an orifice layer 42 is formed on top of the thin film stack 34. The fluidic layer assembly 36 defines the firing chambers 26, the feed channels 28 and the nozzles 16. Although FIGS. 2 and 3 illustrate one possible printhead configuration, namely, two rows of drop generators about a common feed hole, it should be noted that other configurations may also be used in the practice of the present invention.

Figure 4:
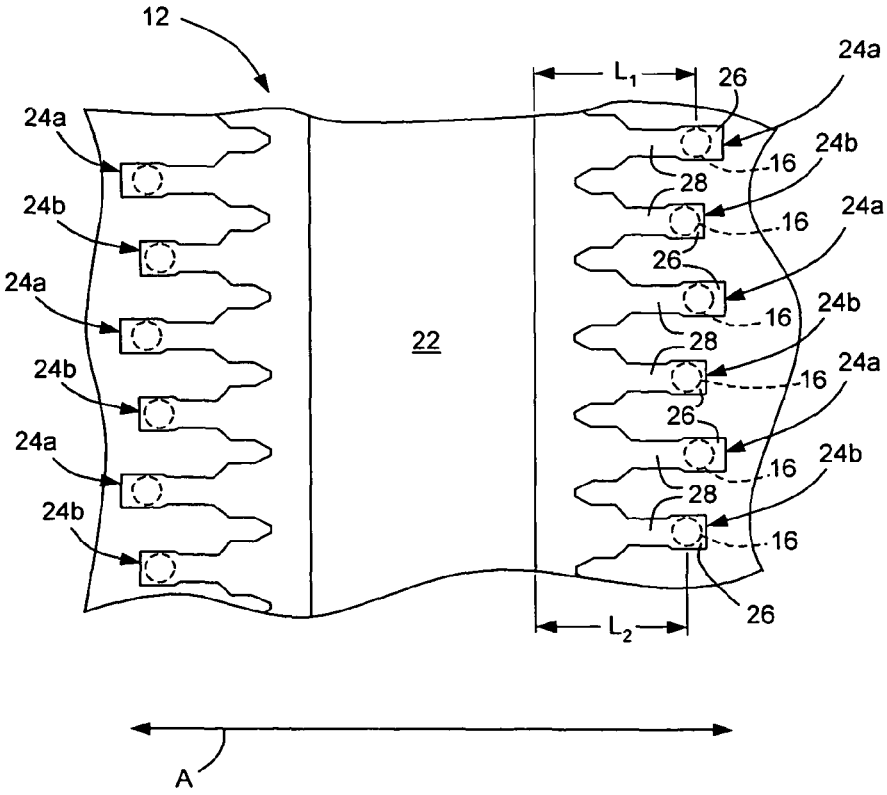
FIG. 4 is a partial cross-sectional view taken along line 4-4 of FIG. 3.

Turning now to FIG. 4, it is seen that the printhead 12 has a "dual inline" architecture rather than a traditional inline design having no stagger or a staggered design having multiple nozzle locations with a unique nozzle location for each address. With the dual inline architecture, all of the nozzles 16 of each column are located at one of two different axial positions relative to the scan axis A of the inkjet pen 10 (nozzle locations shown in dotted lines in FIG. 4). That is, although the nozzles 16 of each column are distributed along the length of the column, nozzles are located at just two different points along the scan axis A. This dual inline architecture can be accomplished in one embodiment by providing two different shelf lengths for the drop generators 24. The shelf length (i.e., the distance between the center of the nozzle 16 and the edge of the fluid feed hole 22 for a given drop generator) determines the location of the nozzle 16 relative to the scan axis A. In the illustrated embodiment, the printhead 12 has only two discrete shelf lengths for all of the drop generators 24, with adjacent drop generators 24 alternating between the two shelf lengths. This means that the drop generators 24 include a first set of drop generators 24*a*, each having a first shelf length $L_1$, and a second set of drop generators 24*b*, each having a second shelf length $L_2$, so that all drop generators 24 have either the first shelf length $L_1$ or the second shelf length $L_2$.

In the illustrated embodiment, the first shelf length $L_1$ is greater than the second shelf length $L_2$, and the difference between these two shelf lengths is set to substantially minimize or reduce dot placement error. In one possible embodiment, a preferred shelf length differential ($L_1$-$L_2$) is in the range of about 0.25 to 2.0 times the dot width column of the printhead 12, and more preferably is about one-half of the dot column width. The "dot column width" of a printhead is the spacing between the centroids of two dots printed by the same nozzle and is dependent on the resolution of the printhead. The resolution, typically measured in dots per inch (dpi), is the number of dots that can be printed per unit length and is a function of how frequently the printhead can fire per unit length of carriage motion. For example, a printhead having a resolution of 1200 dpi can print 1200 dots in a one inch line along the print medium, meaning that the dots are spaced apart by 1/1200 of an inch. Accordingly, the dot column width of the printhead would be 1/1200 of an inch. In this example, the preferred shelf length differential would be 1/2400 of an inch, which is one-half of the dot column width.

Figure 5:
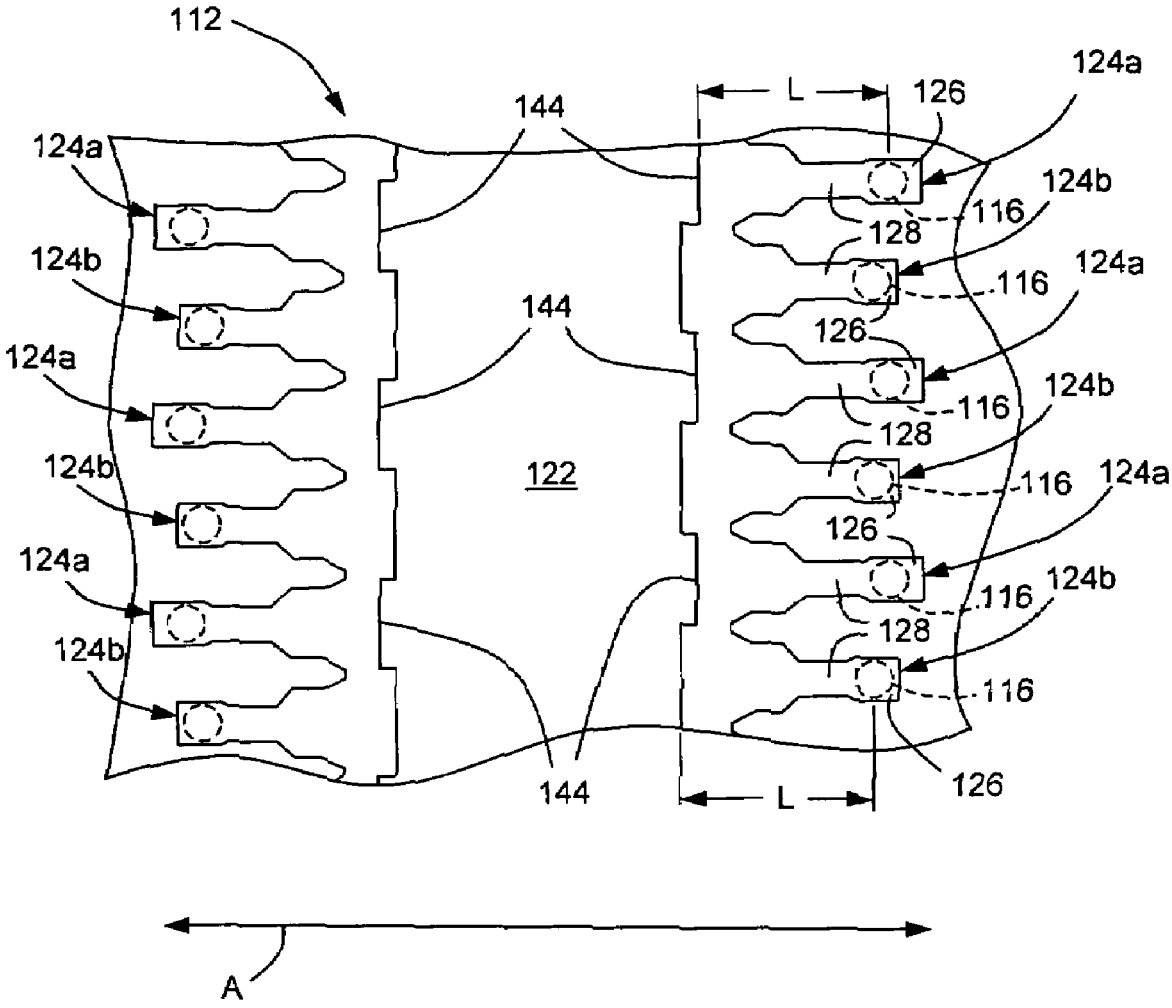
FIG. 5 is a partial cross-sectional view of a printhead showing an alternative inline architecture.

A dual inline architecture can also be implemented without two different shelf lengths. For example, FIG. 5 shows an alternative embodiment of a printhead 112 having a dual inline architecture. That is, all of the nozzles 116 of each column are located at one of two different axial positions relative to the scan axis A of the inkjet pen. The distance along the scan axis A between the first and second axial positions of the nozzles 116 is set to substantially minimize or reduce dot placement error. For example, this distance can be in the range of about 0.25 to 2.0 times the dot width column of the printhead 112, and more preferably about one-half of the dot column width. In this embodiment, cutouts 144 are formed in the edges of the fluid feed hole 122 adjacent to the first group drop generators 124*a*. The depth of the cutouts 144 in the direction of the scan axis A is equal to the distance along the scan axis A between the first and second axial positions of the nozzles 116. In this way, the nozzles 116 of each column are located at one of two different axial positions, but each nozzle has a shelf length associated with it that is substantially equal to the shelf lengths of the other nozzles 116. The drop generators 124 of both groups thus have substantially equal fluidic shelf lengths L. Other implementations may be employed to create equal fluidic shelf lengths for a dual inline architecture.

Referring again to FIGS. 2-4, to eject a droplet from one of the nozzles 16, printing fluid is introduced into the associated firing chamber 26 from the fluid feed hole 22 via the associated feed channel 28. The associated fluid ejector 30 is activated or fired to force a droplet through the nozzle 16. For example, if the fluid ejectors 30 are resistors, the associated resistor is activated with a pulse of electrical current, which causes the resistor to produce heat that heats the printing fluid in the firing chamber 26. This forms a vapor bubble in the firing chamber 26 and forces a droplet of printing fluid through the nozzle 16. The firing chamber 26 is refilled after each droplet ejection with printing fluid from the fluid feed hole 22 via the feed channel 28. While the drop generators 24 can be configured to eject droplets of either uniform or different drop weights, the first group drop generators 24*a* and the second group drop generators 24*b* do not necessarily produce droplets of different drop weights. In fact, the first group drop generators 24*a* and the second group drop generators 24*b* can produce droplets of equal or substantially equal drop weights. The multiple drop generators 24 are typically fired in a predetermined firing order. Generally, the firing order for the dual inline architecture will be such that all of the drop generators of one nozzle location are fired before any of the drop generators of the other nozzle location are fired. Furthermore, it is preferred, although not required, that each primitive has an even number of addresses.

As mentioned above, the drop generators 24 in each column alternate between first group drop generators 24*a* and second group drop generators 24*b*. Alternating adjacent drop generators 24 between the two shelf lengths means that, for any given drop generator 24, its two adjoining drop generators are positioned the same along the scan axis A with respect to that drop generator. In others words, a drop generator's positioning and spacing along the scan axis A relative to the drop generator immediately adjacent to it on one side is the same as the drop generator's positioning and spacing along the scan axis A relative to the drop generator immediately adjacent to it on the other side. Consequently, the relative positioning of the two adjoining nozzles is the same for any given nozzle 16. The dual inline architecture thus eliminates asymmetry or systematic concentricity variations from nozzle to nozzle.

Because the nozzles 16 of each column are located at two discrete locations relative to the scan axis of the inkjet pen 10, the dual inline architecture reduces SAD error by 50% as compared to conventional inline architectures. While this reduced SAD error may not be as good as that obtained with a conventional staggered design, it is acceptable for many applications. Furthermore, the dual inline architecture provides substantially smaller PAD error than conventional staggered designs because there are little or no nozzle-to-nozzle concentricity variations. Other advantages of the dual inline architecture include the need to tune only two shelf lengths and the reduced need for stagger compensation because there are only two configurations that need to be matched and optimized for drop velocity, drop weight, R-life, aerosol, etc. Faster refill speeds are enabled because trajectory errors associated with puddling are reduced. Furthermore, there are no incremental costs or processing involved with the dual inline architecture.

While specific embodiments of the present invention have been described, it should be noted that various modifications thereto can be made without departing from the spirit and scope of the invention as defined in the appended claims.

What is claimed is:

1. A printhead defining a scan axis, said printhead having a column of nozzles formed therein wherein a first group of said nozzles is located at a first axial position relative to said scan axis and a second group of said nozzles is located at a second axial position relative to said scan axis so that all nozzles of said column are located at either said first axial position or said second axial position, and wherein the distance along said scan axis between said first axial position and said second axial position is set to substantially minimize dot placement error and such that the first group of said nozzles overlap the second group of said nozzles along an axis perpendicular to said scan axis, wherein said first group of nozzles and said second group of nozzles produce droplets of at least substantially equal drop weights, wherein the distance between the first axial position and the second axial position is such that center points of the first group of nozzles are collinear with edges of the second group of nozzles along the axis perpendicular to the scan axis, and such that center points of the second group of nozzles are collinear with edges of the first group of nozzles along the axis perpendicular to the scan axis, further comprising a firing chamber in fluidic communication with each nozzle and a fluid ejector disposed in each firing chamber, a fluid feed hole, and a feed channel establishing fluidic communication between the fluid feed hole and each firing chamber, wherein the fluid feed hole has an edge extending along the column of nozzles and defines a plurality of cutouts each associated with a nozzle in the same group.

2. The printhead of claim 1 wherein said nozzles in said column alternate between nozzles from said first group and nozzles from said second group.

3. The printhead of claim 1, wherein all of said nozzles have a shelf length associated therewith, said shelf length is defined as the distance between the center of a nozzle and the edge of the fluid feed hole, and the shelf length for each nozzle is substantially equal.

4. A method of printing comprising:

providing a printhead defining a scan axis and having a column of nozzles formed therein wherein a first group of said nozzles is located at a first axial position relative to said scan axis and a second group of said nozzles is located at a second axial position relative to said scan axis so that all nozzles of said column are located at either said first axial position or said second axial position and wherein the distance along said scan axis between said first axial position and said second axial position is set to substantially minimize dot placement error and each nozzle has a fluid ejector associated therewith and such that the first group of said nozzles overlap the second group of said nozzles along an axis perpendicular to said scan axis; and activating said fluid ejectors to eject droplets from said nozzles, wherein said fluid ejectors are activated in a predetermined firing order such that all of said first group of nozzles are fired before any of said second group of nozzles, wherein said first group of nozzles and said second group of nozzles produce droplets of at least substantially equal drop weights, wherein the distance between the first axial position and the second axial position is such that center points of the first group of nozzles are collinear with edges of the second group of nozzles along the axis perpendicular to the scan axis, and such that center points of the second group of nozzles are collinear with edges of the first group of nozzles along the axis perpendicular to the scan axis, wherein a firing chamber is in fluidic communication with each nozzle and a fluid ejector disposed in each firing chamber, wherein a feed channel establishes fluidic communication between a feed hole and each firing chamber, wherein the fluid feed hole has an edge extending along the column of nozzles and defines a plurality of cutouts each associated with a nozzle in the same group.

5. The method of claim 4 wherein all of said nozzles have a shelf length associated therewith, and the shelf length for each nozzle is substantially equal.

6. The method of claim 4 wherein all of said nozzles have a shelf length associated therewith, and said first group of said nozzles have a first shelf length and said second group of nozzles have a second shelf length that is different than said first shelf length.

7. The printhead of claim 1 wherein all of said nozzles have a shelf length associated therewith, said shelf length is defined as the distance between the center of a nozzle and the edge of the fluid feed hole, and said first group of said nozzles have a first shelf length and said second group of nozzles have a second shelf length that is different than said first shelf length.

* * * * *